US005122995A

United States Patent [19]

Vuilleumier

[11] Patent Number: 5,122,995

[45] Date of Patent: Jun. 16, 1992

[54] CHRONOGRAPHIC FLY-BACK TIMEPIECE HAVING A STOP-START CONTROL FOR THE FLY-BACK HAND

[75] Inventor: Cyril Vuilleumier, Bienne, Switzerland

[73] Assignee: ETA SA Fabriques d'Ebauches, Switzerland

[21] Appl. No.: 789,874

[22] Filed: Nov. 12, 1991

[30] Foreign Application Priority Data

Dec. 11, 1990 [CH] Switzerland ..... 03909/90

[51] Int. Cl.[5] ..... G04F 7/00

[52] U.S. Cl. ..... 368/102

[58] Field of Search ..... 368/101-106

[56] References Cited

U.S. PATENT DOCUMENTS

| | | | |
|---|---|---|---|
| 253,338 | 5/1882 | Audemars | 368/102 |
| 550,182 | 11/1895 | Lecoultre-Piguet | 368/102 |
| 2,548,101 | 4/1951 | Dubet et al. | 368/102 |

FOREIGN PATENT DOCUMENTS

| | | |
|---|---|---|
| 0038824 | 3/1906 | Switzerland . |
| 0337151 | 5/1959 | Switzerland . |
| 2008291 | 8/1983 | United Kingdom . |

*Primary Examiner*—Vit W. Miska

*Attorney, Agent, or Firm*—Pollock, Vande Sande & Priddy

[57] ABSTRACT

A fly-back chronograph provided with a stop-start control for the fly-back hand is provided. The control does not require careful and frequent adjustment and avoids premature wear of the fly-back wheel parts. The control device has fly-back pincer, a fly-back wheel disposed between the free extremities of the two branches of the said pincer, two fixed reaction members against which a connecting member between the two branches of the pincer bear and deformation means creating a force acting against the said reaction members on the said portion of the connecting member in order to deform it.

7 Claims, 6 Drawing Sheets

Prior art

CHRONOGRAPHIC FLY-BACK TIMEPIECE HAVING A STOP-START CONTROL FOR THE FLY-BACK HAND

FIELD OF THE INVENTION

The instant invention relates to a chronographic fly-back timepiece equipped with a stop-start control for the fly-back hand.

For chronometers for sporting events such as track events, one generally uses a mechanical or electromechanical chronometer, having a timekeeping movement which controls the display members such as a second hand termed the "chronographic hand", a minute counter and an hour counter. By means of such a chronometer one is able to determine the time taken by a runner to cover a given distance.

Nevertheless, it is generally desirable to be able to measure, using the same chronometer, either the respective times of several runners in the same event, or the intermediate time or times of one of the runners, as well as the final time on arrival. Moreover, a chronograph in its simplest from, for example a chronograph having only a single button, is not able to measure several times successively, since it is of necessity essential to return the display members to zero after each measurement. In this case one must have recourse to a chronometer having a supplementary second hand called the "fly-back" hand. When one wishes to measure a first intermediate time, one can stop at will and at any time, the fly-back hand which makes it easy to read, and can then make this hand "fly-back" over an elapsed time so that it joins up with the chronograph hand which has not stopped revolving. The fly-back hand may be stopped several times in order to measure intermediate times or indeed to measure the final time of stopping the hand of the chronometer, the counters and the fly-back hand if the latter has not already been stopped.

DESCRIPTION OF THE PRIOR ART

Chronographs having fly-back hands as well as control means for this hand have already been proposed and are described for example in the patent GB 2 008 291 or in the book "Le chronographe" by B. Humbert (chapter 13).

In FIGS. 1 and 2 of the accompanying drawings a chronograph is shown having control means for a fly-back hand according to the prior art. In the sectional view of FIG. 2 the dial of the chronograph is at the top. The chronograph having a fly-back mechanism is provided with a centre-wheel 1 forming part of a wheel 3 having a hole extending completely therethrough, a chronograph wheel 5 of which the tube 7 is pivoted in the interior of the wheel 3 and a fly-back wheel 9 of which the staff 11 is freely adjustable within the tube 7.

On the free extremity of the staff 11 there is affixed a fly-back hand 13 whereas the other extremity of said staff abuts against a stone 14 set in a bar 16. A chronograph hand 15 is affixed to one extremity of the tube 7. To the other extremity of this tube there is affixed a heart 17, called the fly-back heart which is integral rotatably with the chronograph wheel 5. In addition a chronograph heart 19 is affixed to the side of the tube 7 against the chronograph wheel 5. The various parts of the chronograph are disposed on either side of a chronograph base plate 21 and a bridge 23.

A lever 25 is mounted pivotally on a felloe 27 (FIG. 1) of the fly-back wheel 9 and pivots about an axis 29.

At the free extremity of the lever 25 there is rotatably mounted a runner 31, preferably of ruby. This lever 25 is activated by a spring 33 which as also mounted on the felloe 27. The runner 31 is always held in contact with the circumference of the fly-back heart 17 by the action of this spring 33.

The fly-back wheel 9 is held between the two branches 35 and 37 of a fly-back pincer 39 in the from of a U to the extent that the ends of the two branches are able to grip the wheel 9 at two diametrically opposed points. A column-wheel 41 is disposed between the two branches 35, 37 at the middle portion thereof. The column-wheel 41 is provided at its upper portion (as seen in FIG. 1), that is to say the part directed towards the base of the chronograph case, with a cam 42 having eight columns 43 regularly disposed about its periphery and in its lower part a ratchet 44 having sixteen teeth 45.

This column-wheel 41 may be driven in rotation in the direction of the arrow F1 by a pawl 47 which acts on the teeth 45. The pawl 47 may itself be set in motion by means of a lever 49, always being subject to the action of the spring 51. Rotation of the column-wheel 41 is blocked by a jumper 53 and the fly-back pincer 39 pivoting freely about a stud 55 mounted on an extension of the foot of the jumper 53. Finally, the two branches 35 and 37 of the fly-back pincer are equipped with beaks, 57 and 59 respectively, which cooperate with the columns 43.

When the column-wheel 41 is driven in rotation, the two branches 35 and 37 can shift between two positions. In a first position represented in FIG. 1, the beaks 57 and 59 are located respectively between two neighbouring columns 43, so that the branches 35 and 37 pinch the fly-back wheel 9 and block it. In a second position (not shown) the beaks 57, 59 are respectively supported between two diametrically opposed columns 43, which results in the branches 35 and 37 being moved away from the wheel 9. Transition from the first position of the branches to the second thus occurs in the direction of the arrows F2.

The use and functioning of this fly-back device is as follows.

When the chronograph is being used to measure time, the runner 31 located at the extremity of the lever 25 rests in the notch 61 of the fly-back heart 17. Consequently, when the chronograph wheel 5 turns, advancing by steps, driven by a motor wheel (not shown), it drives not only the tube 7, the fly-back heart 17 and the chronograph hand 15, but also the fly-back wheel 9, by means of the lever 25. The fly-back wheel 9 turns synchronously with the chronograph wheel 5 and the two hands 13 and 15 are simultaneously superimposed the one on the other.

When the user wishes to read off an intermediate time he exerts a pressure in the direction of the arrow F3 on the lever 49. This has the effect of turning the column-wheel 41 one step (arrow F1) and to bring it in the position shown in FIG. 1. The fly-back pincer 39 thus blocks the fly back wheel 9 as well as the pivot 11 and the fly-back hand 13, which enables the intermediate time to be read off. During this operation, the chronograph wheel 5, the chronograph hand 15 and the fly-back heart 17 continue to turn step by step.

When the fly-back wheel 9 and its lever 25 are blocked, but the fly-back heart 17 continues to turn, the runner 31 comes out of the notch 61 but remains resting against the circumference of the heart 17 due to the spring 33.

After having read off the intermediate time, the user exerts a second pressure on the lever 49. This has the effect of turning the column-wheel 41 by a further step and of moving the arms 35 and 37 away from the pincer 39. The fly-back wheel 9 is thus freed and turns until the runner 31 of the lever 25 again comes into the notch 61 under the action of the spring 33 which has been stretched during the rotation of the fly-back wheel. The two hands 13 and 15 then start to turn again together.

The multiplicity of hands which may have to be driven by wheels located at the centre of a chronograph makes it necessary for the watchmaker to observe certain precautions regarding the construction of this centre.

Indeed, referring to FIG. 2, one observes that these wheels have a considerable length as compared to their diameter and to the radial play which separates them. If a wheel for whatever reason, starts rubbing against the coaxially adjacent wheel, there is a risk that at the worst it will no longer rotate the driving forces moving them, due to the extremely weak construction. At best, there would be premature wear on these wheels.

In order to avoid these problems, the watchmaker takes the precaution of providing clearances between the wheels solely at one extremity thereof (that is to say generally near the hands) as is shown in FIG. 2. The other extremity of the wheel is thus urged against an axial abutment (jewel 14, FIG. 2) without being held radially. The wheels in question can thus adjust each other radially the one against the other without there being any premature wear or locking on rotation.

Furthermore it should be understood that the fly-back pincer described above introduces a supplementary problem. Thus, if one considers that this pincer does not operate completely symmetrically on the fly-back wheel 9, the latter will tend to tilt and to exert a bias on the wheel supporting it. The staff 11 thus risks, if not to be completely blocked, then at least to rub against the interior of the tube 7, resulting in premature wear of these parts. Further adjustment is thus necessary. This risk becomes all the more likely since the stud 11 has a length very much greater than its diameter.

This problem of tilting of the axis 11 resulting from the pincer 39 is especially likely to occur if there is any slight error in the dimensions of the columns 43. As a result, if one of the columns does not coincide or more with the periphery of the cam 42 then it does not provide separation, or enough separation of the corresponding branch, when it is opposite it. The other branch will thus exert a residual force on the fly-back wheel 9. Moreover, these differences in the dimensions of the columns 43 are difficult to avoid as a result of manufacturing tolerances and wear. This control device is thus fragile and to avoid problems it must be adjusted with great precision not only during manufacture but also later on, to compensate for the effects of wear.

It is thus an object of the instant invention to overcome these difficulties.

BRIEF SUMMARY OF THE DRAWINGS

It is thus an object of the instant invention to provide a timepiece of the fly-back chronograph type, provided with a control device for stopping and starting a fly-back hand, the timepiece comprising a fly-back wheel integral with the said fly-back hand, a fly-back pincer substantially in the form of a U with two branches connected by a connecting member, the fly-back wheel being disposed between the free extremities of the two branches and means adapted to deform said pincer in a manner such that it can assume two configurations, namely a first configuration, called the closed, in which each branch of the pincer is in contact with the circumference of the fly-back wheel so as to block the latter and thereby to stop the fly-back hand, and a second configuration, called the open, in which the two branches of the pincer are not in contact with the fly-back wheel, so as to release the latter and to permit movement of the said fly-back hand, the said timepiece also comprising two fixed reaction members against which the said connecting portion bears and whereby said deformation means comprise means for generating a force acting against the said reaction members on the said connecting portion in a zone situated between the said reaction members, said connecting portion being formed in a manner so as to have in the plane of the pincer, a resilient deformability greater than the resilient deformability of the said branches in the same plane.

Due to these features, the control device is capable of simultaneously separating the branches from the fly-back wheel and to allow them to approach each other simultaneously in the same manner so as to avoid any radial asymmetric force on the fly-back wheel.

BRIEF DESCRIPTION OF THE DRAWINGS

Figure 1:
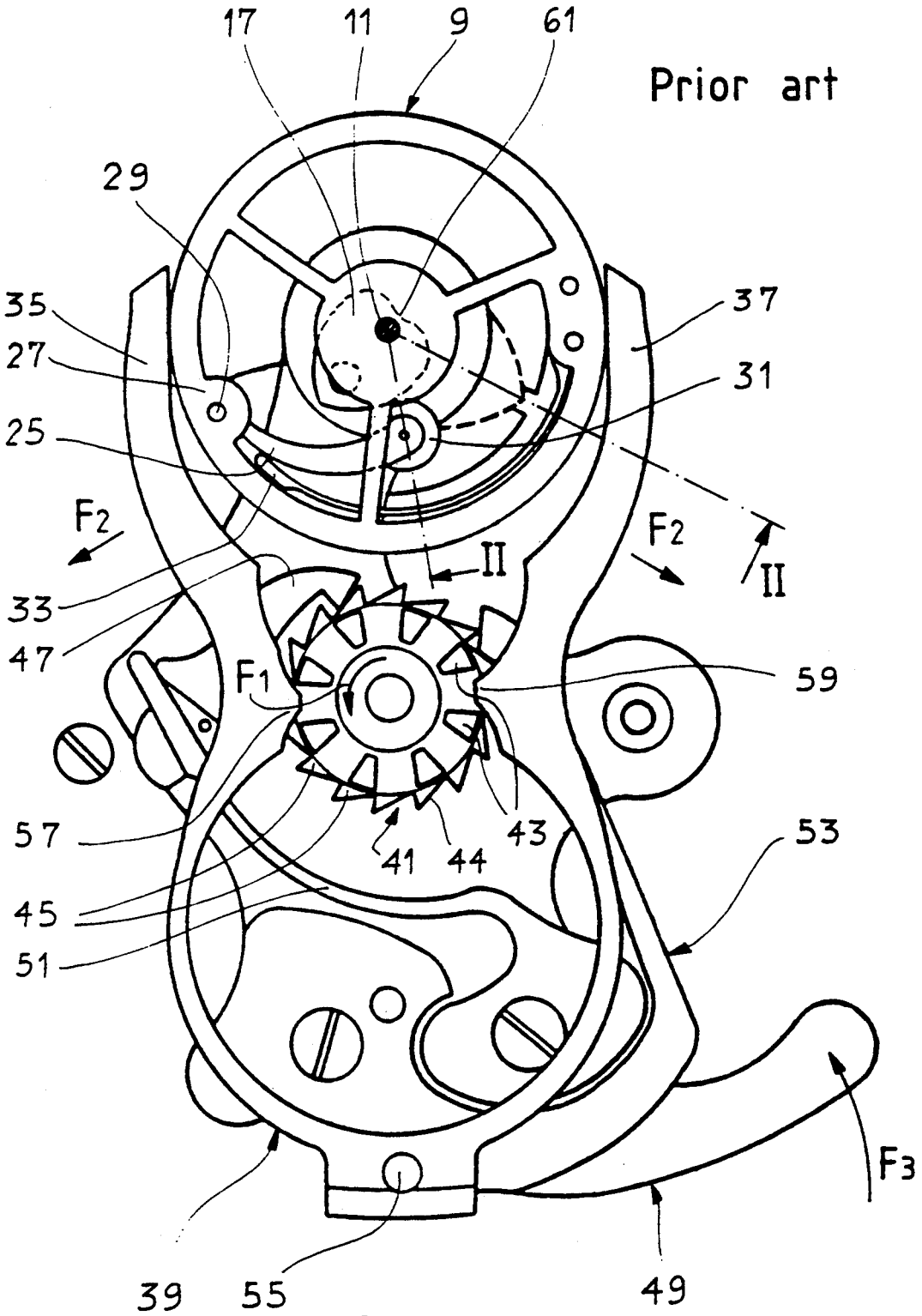
Figure 2:
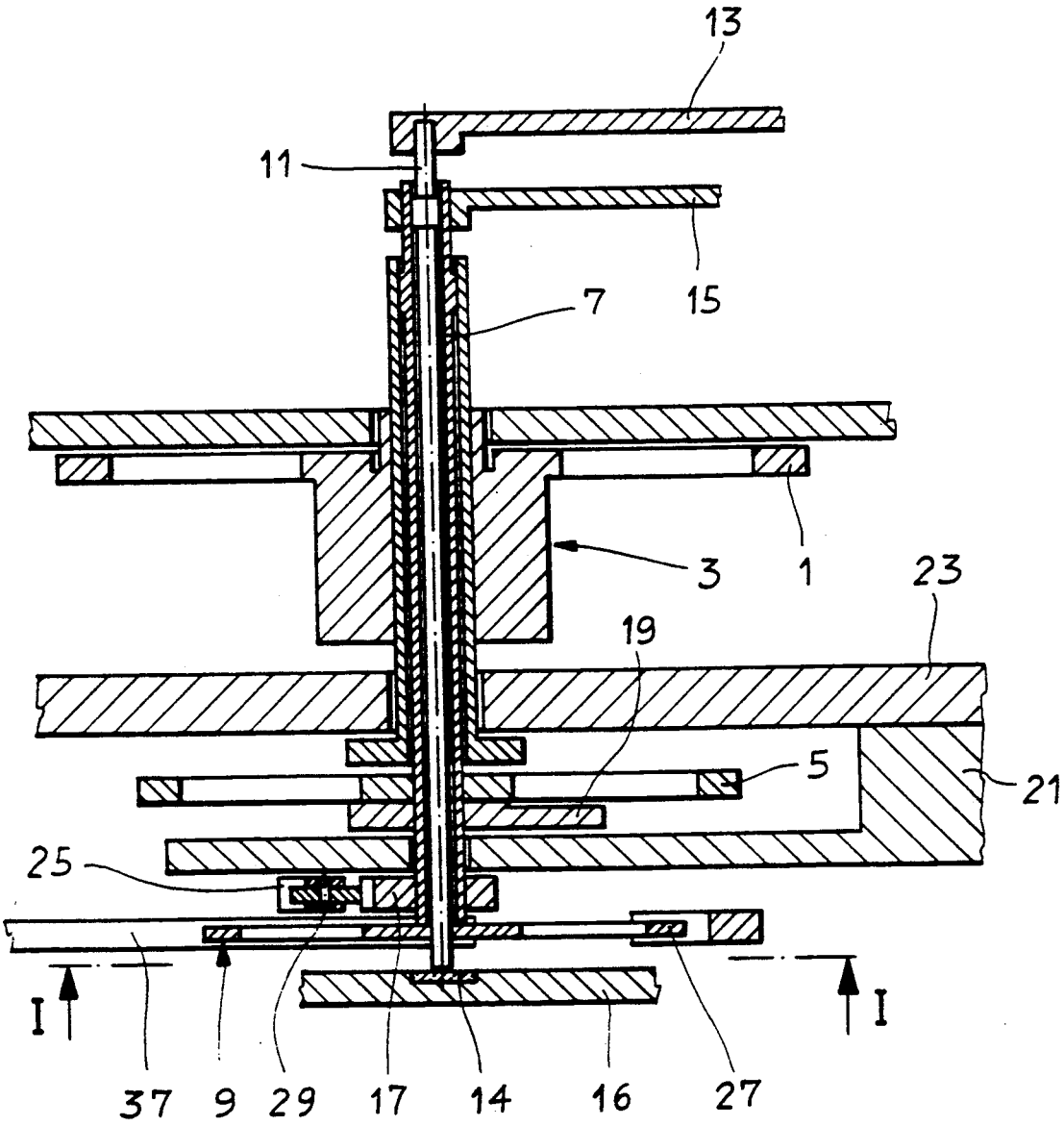
Figure 3:
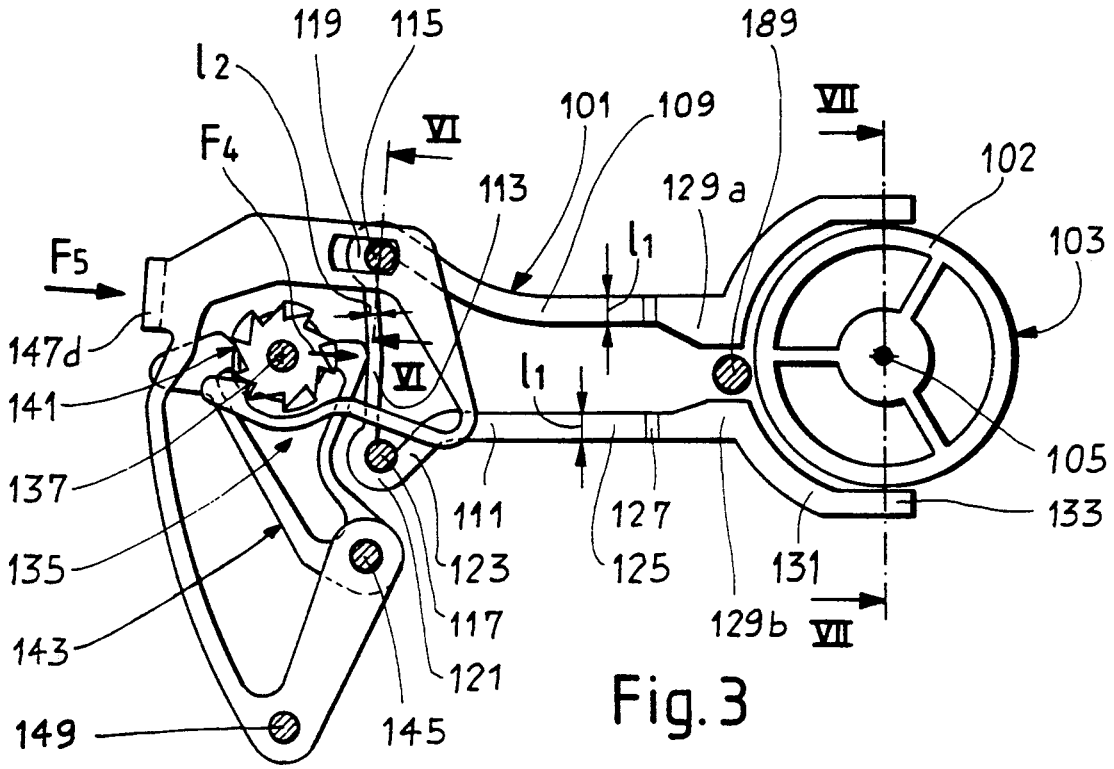
Figure 4:
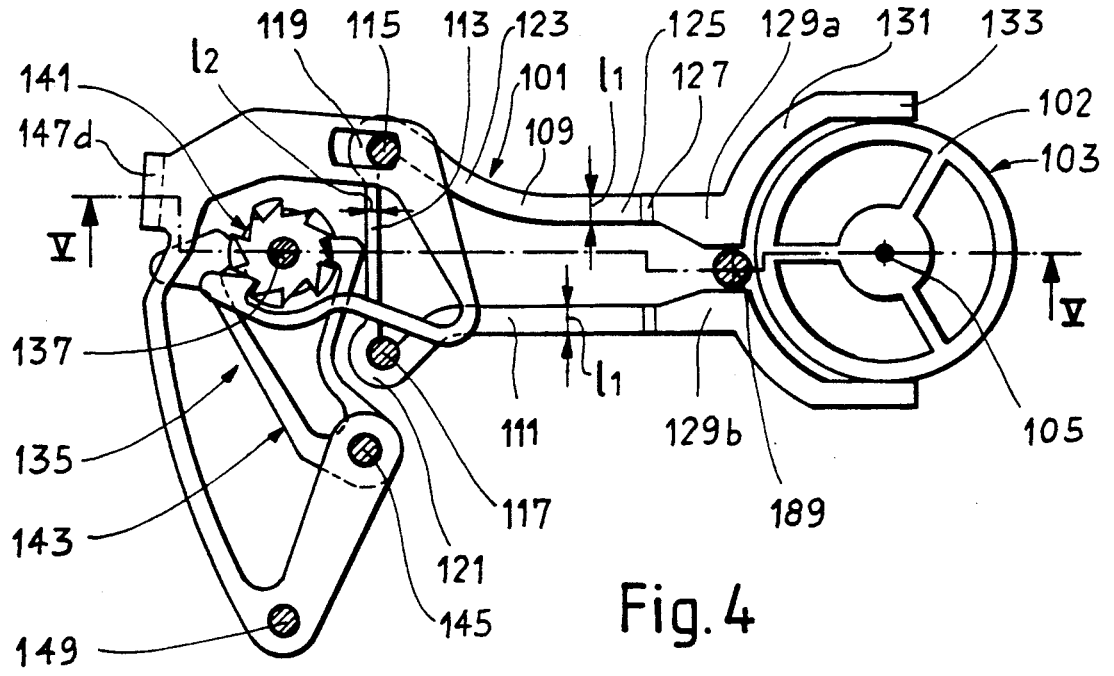
Figure 3A:
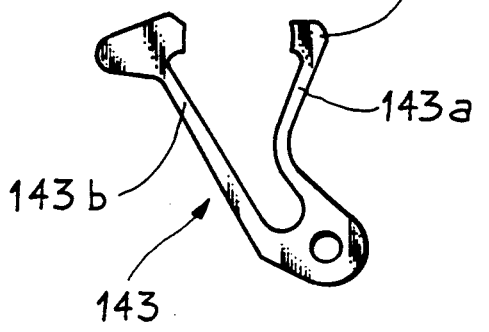
Figure 3B:
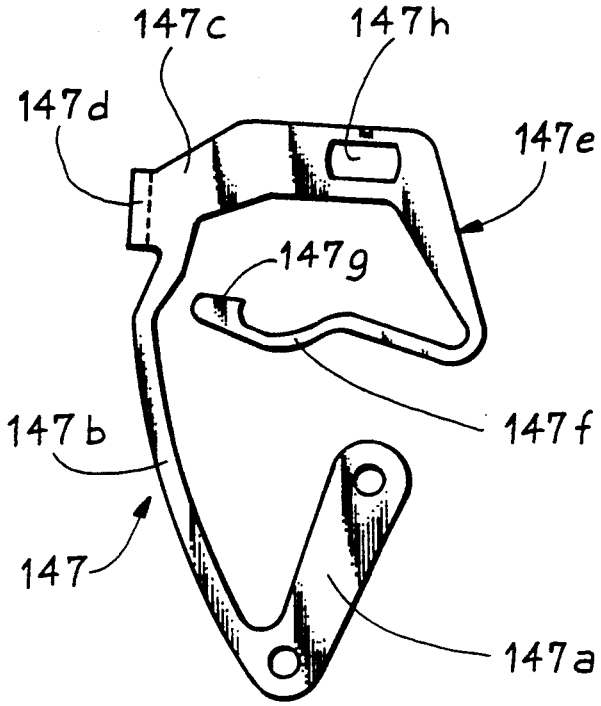
Figure 6:
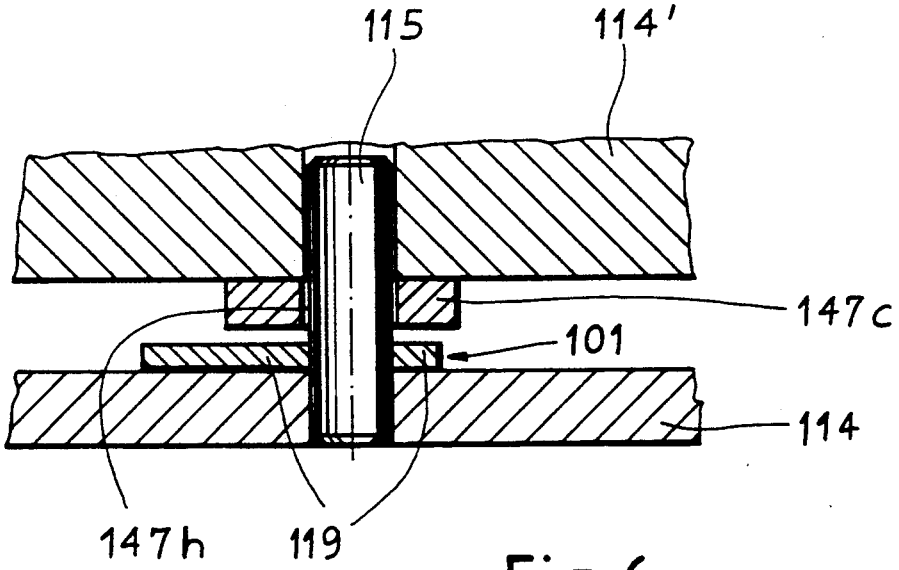
Figure 5:
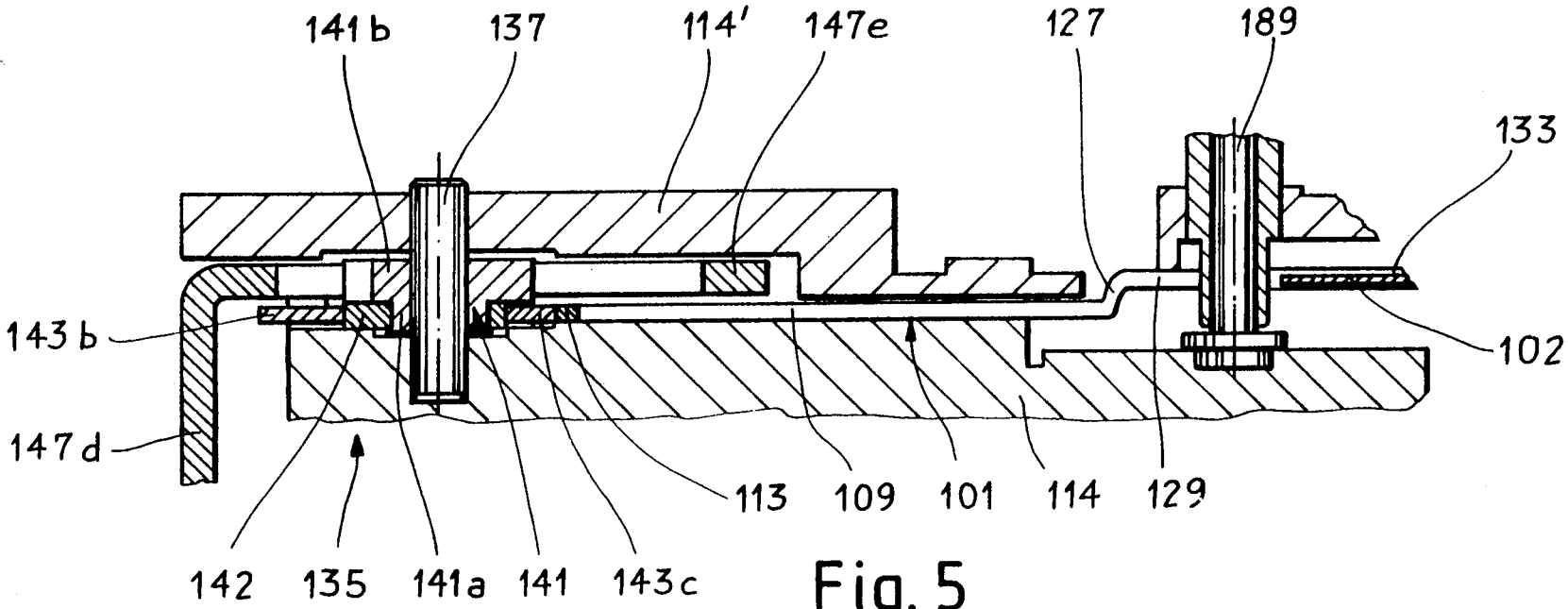
Figure 7:
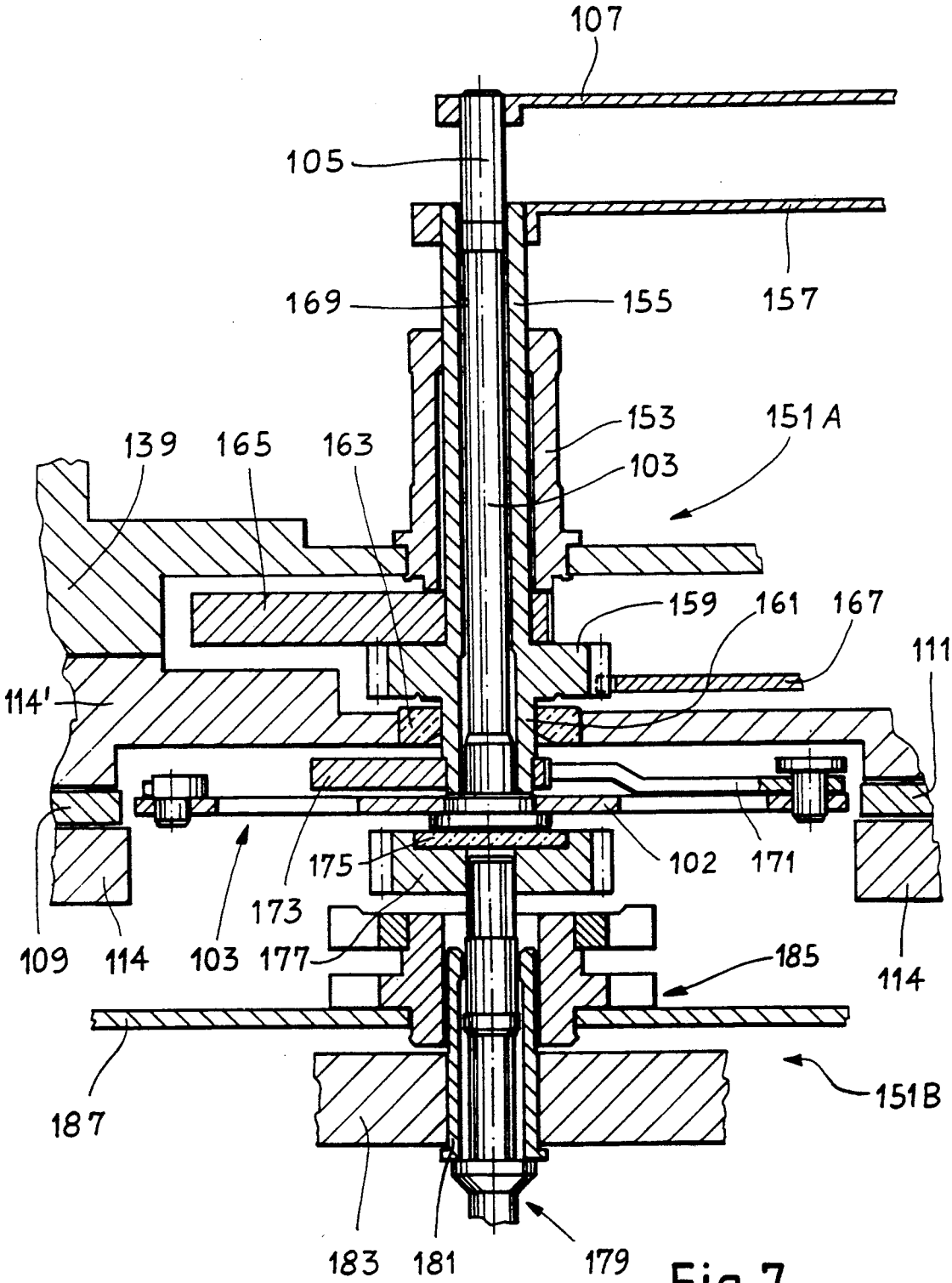

The invention will be better understood with reference to the following description which is given by way of illustration only and does not limit the invention in any way and also with reference to the accompanying drawings in which:

FIG. 1 shows a plan view from below of a device for controlling a fly-back hand for a chronograph according to the prior art, FIG. 2 is a sectional view along the line II—II of FIG. 1, FIGS. 3 and 4 are views from above of a control device according to the instant invention, parts which lie above the fly-back wheel not being shown, FIGS. 3A and 3B show separately two essential members of the control device according to the invention, FIG. 5 is a sectional view on an enlarged scale along the line V—V of FIG. 4, FIG. 6 is a view along the line VI—VI of FIG. 3 on an enlarged scale, and FIG. 7 is a sectional view on an even larger scale along the line VII—VII of FIG. 3.

DETAILED DESCRIPTION OF THE INVENTION

According to the embodiment of the invention shown in FIGS. 3 to 7, the control device comprises a fly-back pincer 101 adapted to cooperate with the wheel 102 of the fly-back wheel 103 of a chronograph. This wheel 103 is provided with a pivot 105 on the extremity of which is fixed a fly-back hand 107 (only shown in FIG. 7). The fly-back pincer 101, which is formed in one piece substantially having the form of a U has two branches 109 and 111 joined by a strip 113 which forms the connecting part. The wheel 102 of the fly-back wheel 103 is disposed between the two free extremities of the branches 109 and 111.

The control device is mounted on a support plate 114 in which are fixed two pins 115 and 117 which fulfil the function of being reaction members.

In the junction zones between the branches 109 and 111 and the connection strip 113 there are provided curved connection pieces 115 and 117 respectively passing through an angle of about 270° thus providing a good seating for the pincer 101.

Each branch 109, 111 comprises in addition passing in the direction of its free extremity, an elbow part 123 leading back again to the other branch, a straight portion 125 in which is provided a hook portion 127, a widened portion 129*a*, 129*b* and an arcuate portion 131 extending towards the exterior of the pincer followed by a straight pressing portion 133 which is disposed tangentially with respect to the periphery of the wheel 102.

The portion of each branch situated on either side of the hook portion 127 being disposed in different planes, those situated on the side of the wheel 103 are further away from the support plate.

It may further be noted that in the direction away from each arcuate portion 119, 121 each branch has a width $l_1$ which is greater than the width $l_2$ of the connecting strip 113. In this way, the branches 109 and 111 have a much greater rigidity in the plane of the pincer than the connecting strip 113 which is the point at which deformation of the pincer is made when it is activated in order to release the wheel 103.

It will now be explained how the latter is held in place in the direction perpendicular to its actual plane.

The control device also includes deformation means 135 which are constructed as follows.

The pin 137 is fixed in the plate 114 and is held at its other extremity by a bridge 114'.

Around this pin 137 there is rotatably mounted a wheel 141 having two tiers 141*a* and 141*b*. The first tier 141*a* located closest to the support plate 114 carries a cam 142 which may for example have five shoulders, whereas the second tier is in the form of a ratchet 141*b* in the present case having ten triangular teeth.

The cam 142 is located in the plane of the pincer 101.

The control device is also provided with a pusher and positioning member 143 in the form of a V-shaped spring (FIG. 3A) of which the point is so mounted that it is able to pivot about a pin 145 fixed in the support plate 114.

A first branch 143*a* of this V-shaped spring extends from the pin 145 to a gap arranged between the cam 142 and the deformable strip 113 of the pincer 101. The free extremity of this branch is so formed that it constitutes a head 143*c* for the transmission of movement which is in resilient contact with the deformable strip 113.

The other branch 143*b* of the pushing and positioning member 143 in the form of a jumper to block rotation of the wheel 141 and the cam 142 when the control device is in operation (FIG. 3). In the other case it is the other branch 143*a* of the member 143 which ensures blocking of rotation of the wheel 141.

The control device also has a control lever 147 (FIG. 3B), formed of a bent back blade fixed at one of its end portions 147*a* to a pin 145 and to another pin 149 situated a given distance from the latter and also fixed to the support plate 114.

A resiliently deformable straight portion 147*b* extends from the pin 149 in the direction of the wheel 141 where it is extended by a wider and more rigid section 147*c* extending more or less at a right angle to the straight section 147*b*.

A curved tongue 147*d* lying outside the plane of the control lever is adapted to cooperate with a push-button (not shown) disposed outside the chronograph case (see in particular FIG. 5).

The section 147*c* is connected with an operating part 147*e* in the form of a V of which the free branch 147*f* comprises a head in the form of a hook 147*g* adapted to act against the ratchet 141*b*.

An aperture 147*h* is cut into the section 147*c* at the point corresponding to the pin 115 which ensures guidance of the control lever 147 and avoids deformation outside the plane of the lever when the latter is operated.

In addition the section 147*e* of the V extends above the rear portion of the pincer 101 in order to keep it in place and to prevent it becoming detached from the support plate 114 (see in particular FIGS. 5 and 6).

FIG. 7 represents in part a module 151A of a fly-back chronograph intended for use in a watch movement 151B of the usual type, the control device of the invention being incorporated in the first module 151A.

As indicated above, this module 151A is constructed on the support plate 114 on to which are mounted the bridges 114' and 139. A centre tube 153 is fixed to the latter.

In the interior of the centre tube 153 there rotates a member 155 of which one extremity carries the chronograph hand 157 and of which the other extremity carries a chronograph pinion 159 and ends in a shoulder 161 which turns in a bearing 163 set in the bridge 114'. A chronograph heart 165 adapted to be reset to zero and constructed in a conventional manner is fixed to the wheel 155 above the pinion 159. This wheel is driven by a seconds wheel 167 the rotation of which is ensured in a conventional manner by way of the watch movement 151B, with which the chronograph module 151A is associated. This watch movement 151B is only very partially represented in FIG. 7.

The wheel 155 has an axial passage 169 passing therethrough into which is inserted the pivot 105 which forms part of the fly-back wheel 103 and to which is fixed the wheel 102 as well as the hand 107. The fly-back wheel 102 is constructed in a conventional manner (as shown in FIG. 1). It is thus equipped with a fly-back lever 171 equipped with a runner (not shown in FIG. 7), and with a support spring (also not shown) acting on this lever 171. A fly-back heart 173 is fixed to the wheel 155 and cooperates with the lever 171 in order to execute the fly-back operation.

It is of course clear that the wheel 102 also cooperates with the pincer 101 which is also part of the control device according to the invention.

FIG. 7 also shows that the fly-back wheel abuts axially against a jewel 175 mounted in a wheel 177 carried by a seconds wheel at the centre 179 forming part of the watch module 151B with which the chronograph module 151A equipped with the control device according to the invention, is associated.

The second wheel at the centre 179 turns in the centre tube 181 fixed in the support plate 183 of the watch movement 151B. Around the centre tube 181 there rotates a canon pinion wheel 185 equipped with its pinion wheel 187 which is of conventional construction.

However, according to a particular characterising feature of the instant invention, the seconds wheel at the centre 179, has alongside the chronograph module 151A, a length such that the wheel 177 which it carries can easily be adjusted axially. This adjustment possibility, in spite of the presence of the inevitable manufacturing tolerances, makes it possible always to set the axial support of the fly-back wheel 103 to its correct value. The association of any mass-produced watch module with a mass-produced chronograph module manufactured as described above may thus be made without there being any risk of clamping or premature wear of the rotating elements at the centre of the assembly.

The functioning of the control device of the instant invention will now be described.

In the situation represented in FIG. 3, the pincer 101 does not act on the fly-back wheel 102. This means that the fly-back wheel 103 and the chronograph wheel 155 are integral on rotation, the hands 107 and 157 are superimposed and move together. In effect, when the runner of the lever 171 is situated in the notch of the heart 173 there exists an axial coupling between the two wheels.

The pincer 101 is held open by the control device when the V shaped spring 143 acts against the deformable strip 113 by exerting a force in the direction of the arrow F4, that is to say perpendicular to the strip 113. The strip is thus in a curved configuration, which separates the branches 109 and 111 of the pincer which are relatively rigid in the plane of the latter.

The spring 143 in enabled to exert a force F4 against the strip 113 due to the fact that its head 143*c* bears against one of the raised areas of the cam 142. The two tiered wheel 141 to which this cam is fixed, is held rotatably immobile due to the action of the other branch 143*b* of the V-shaped spring 143 of which the extremity acts as a jumper and bears against a depressed area of the cam 142. The presence of the V-shaped spring 143 is very important. Indeed, this spring permits the transformation of the rotational movement of the cam 142 into a translational movement of the head 143*c*, and thus the force F4 is exerted perpendicularly against the strip 113. If the spring 143 were absent and if it was the cam 142 which exerted the force F4, then this would not be perpendicular to the strip 113 owing to the rotational movement of the cam 142. There would thus be the rusk that the pincer 101 would not open in a symmetrical manner.

The situation where a chronograph user wishes to read off an intermediate time of the total time to be measured is now described.

In order to do this, it is necessary by means of a control button (not shown), to press against the tongue 147*d* of the control lever 147 in the direction of the arrow F5. This action has the effect of pivoting the lever due to resilient deformation of the branch 147*b*, the movement also being guided owing to the pin 115.

Pivoting the control lever 147 has the effect of turning the wheel 141 by one step, the amplitude being determined by the size of the teeth of the ratchet 141*b*.

The control device thus passes over from the configuration shown in FIG. 3 to that shown in FIG. 4. Indeed, movement by one step of the wheel 141 opposite to the position of the head 143*c* causes the branch 143*b* to jump with respect to the cam 142, the head 143*c* descending into a depressed area of the latter and the branch 143*b* resting on a raised area. The result is that the cam is again prevented from rotating, the head 143*c* fulfilling the function of the jumper in this case.

The strip 113 thus once more tends to assume a rectilinear form, the branches 109 and 111 adjusting themselves once more This adjustment of the branches is simultaneous and symmetrical which avoids any asymmetric force against the chronograph wheel 103 causing it to tilt.

The branches 109 and 111 of the pincer 101 prevent the wheel 103 from turning, which stops the hand 107 and enables the intermediate time to be read. The chronograph wheel 155, on the other hand continues to turn normally to indicate the time passing by means of the hand 157.

During this rotation the runner of the lever passes out of the notch of the heart 173 in a conventional manner.

After reading off the intermediate time, the user again activates the control lever 147*d* which causes the wheel 141 and the cam 142 to advance by a further step. There is thus inversion in the positions of the head 143*c* and the jumper 143*b* of the V-shaped spring 143 leading the control device into the configuration shown in FIG. 3. Consequently, the strip 113 is again bent thereby separating the branches 109 and 111 of the pincer 101. This separation again takes place symmetrically and simultaneously for the two branches thereby avoiding any radial force on the wheel 102 of the chronograph wheel 103.

As soon as the wheel 102 is freed, the wheel 103 is driven rotatably by the force exerted by the lever 171 which then turns this wheel 102 until the runner again passes into the notch of the heart 173. The hand 107 has then caught up with the hand 157 so that it turns synchronously with the latter, the hands being rigorously superimposed.

According to a particularly advantageous feature of the invention, each branch 109 and 111 of the pincer 101 is provided with an enlarged portion 129*a*, 129*b* cooperating with a fixed pin 189 located between the branches 109 and 111 and secured in the support plate 114. Depending on where the pin is located (which may be a function of the available space and not necessarily symmetrical with respect to the two branches) the portions 129*a*, 129*b* may have different lateral dimensions. This is the case in the embodiment shown in FIGS. 3 and 4.

This arrangement of the pin 189 between the two widened portions 129 is designed to limit the movement together of the branches 109 and 111 to a predetermined maximum extent.

I claim:

1. A timepiece of the type having a fly-back hand, provided with a control device for stopping and starting a fly-back hand, the timepiece comprising a fly-back wheel integral with the said fly-back hand, a fly-back pincer substantially in the form of a U with two branches connected by a connecting member, the fly-back wheel being disposed between the free extremities of the two branches and means adapted to deform said pincer in a manner such that they can assume two configurations, namely a first configuration called the closed, in which each branch of the pincer is in contact with the circumference of the fly-back wheel so as to block the latter and thereby to stop the fly-back hand, and a second configuration, called the open, in which the two branches of the pincer are not in contact with the fly-back wheel, so as to release the latter and to permit movement of the said fly-back hand, whereby the said timepiece also comprises two fixed reaction members which support the said connecting member and whereby said deformation means comprise means for generating a force acting against the said reaction members on the said connecting portion in a zone situated between the said reaction members, said connecting member being formed in a manner so as greater than the resilient deformability of the said branches in this same plane.

2. A timepiece according to claim 1, wherein the branches of the pincer have a width greater than the width of said connecting member.

3. A timepiece according to claim 1, wherein the said reaction members are pins mounted in a base support of the said timepiece.

4. A timepiece according to claim 1, wherein the said deformation means are so arranged as to apply a deformational force (F4) at the centre of the said connecting member, symmetrically with respect to the said pins.

5. A timepiece according to claim 1, wherein the said connecting member is provided with arcuate portions that are an integral part of the pincer and passes around the said pins at an angle of 270°.

6. A timepiece according to claim 1, wherein the said deformation means comprise a control wheel formed from a two tier wheel, one of the tiers forming a ratchet and a cam being affixed to the other tier, and said wheel is rotatably mounted with respect to the said pincer and associated with a step by step control for its rotation and said cam is situated adjacent to the said portion of the said connecting piece, with the interposition of a pusher member adapted to operate selectively the said deformation following the raised and depressed areas of the cam in the course of its stepwise rotation.

7. A timepiece according to claim 6, wherein the said pusher member is formed of the extremity of one of the branches of a V-shaped spring of which the other branch constitutes the jumper also cooperating with the said cam.

* * * * *

UNITED STATES PATENT AND TRADEMARK OFFICE

CERTIFICATE OF CORRECTION

PATENT NO. : 5,122,995

DATED : June 16, 1992

INVENTOR(S) : Cyril Vuilleumier

It is certified that error appears in the above-identified patent and that said Letters Patent is hereby corrected as shown below:

Column 8, line 67, change "member" to --portion--.

Column 9, line 4, change "member" to --portion--, and before "greater" insert --to have in the plane of a pincer, a resilient deformability--; line 9, change "member" to --portion of the connector--.

Signed and Sealed this

First Day of March, 1994

Bruce Lehman

*Attest:*

BRUCE LEHMAN

*Attesting Officer*

*Commissioner of Patents and Trademarks*